US007416077B2

(12) United States Patent
Kataoka et al.

(10) Patent No.: US 7,416,077 B2
(45) Date of Patent: Aug. 26, 2008

(54) CONTACT LENS CARRYING CASE

(75) Inventors: Hideharu Kataoka, Toyota (JP); Takashi Osamura, Toyota (JP); Yoshiko Teraoka, Toyota (JP)

(73) Assignee: Nihon Optical Co., Ltd., Toyota-shi, Aichi (JP)

( * ) Notice: Subject to any disclaimer, the term of this patent is extended or adjusted under 35 U.S.C. 154(b) by 195 days.

(21) Appl. No.: 10/677,893

(22) Filed: Oct. 1, 2003

(65) Prior Publication Data

US 2004/0112766 A1 Jun. 17, 2004

(30) Foreign Application Priority Data

Oct. 4, 2002 (JP) ..... 2002-292407

(51) Int. Cl.
*A45C 11/04* (2006.01)
*B65D 43/00* (2006.01)
*B65D 41/32* (2006.01)

(52) U.S. Cl. ..... 206/5.1; 220/337; 220/265; 220/266; 215/253; 215/235; 215/237; 215/250; 215/252; 206/807

(58) Field of Classification Search ..... 206/5, 206/6.1 X, 1.5 X, 807 X, 210, 438, 308.2, 206/387.11; 215/250, 252 X, 253, 901; 220/265, 266 X, 337, 338
See application file for complete search history.

(56) References Cited

U.S. PATENT DOCUMENTS 2,996,938 A * 8/1961 Holtzclaw et al. ..... 81/3.09
3,494,458 A * 2/1970 Meierhoefer ..... 206/366
4,337,858 A * 7/1982 Thomas et al. ..... 206/5.1
4,493,433 A * 1/1985 Sideri et al. ..... 220/788
4,658,980 A * 4/1987 Lindstrom ..... 220/214
4,939,917 A * 7/1990 Cartwright ..... 70/456 R (Continued)

FOREIGN PATENT DOCUMENTS

EP 0685179 A1 12/1995

(Continued)

OTHER PUBLICATIONS

Patent Abstracts of Japan, Publication No. 2002306227, Published on Oct. 22, 2002.

(Continued)

*Primary Examiner*—Jila M Mohandesi
(74) *Attorney, Agent, or Firm*—Beyer Law Group LLP

(57) ABSTRACT

A disposable-type carrying case wherein the parts that house contact lenses cannot be re-sealed is realized via an easy-to-use construction.

In the case main unit 10B of a contact lens carrying case 10, when a handle 12 that is integrally formed with a cover unit 20B is rotated in the clockwise direction, end portions 27G and 27H that are integrally formed with the handle 12 are gradually lifted up starting with the parts thereof that are near the handle 12 while engaging members 40G and 40H are fixed in position. When this occurs, first bridges 29G and 29H that are connected to end portions 27G and 27H are strongly pulled in the direction of rotation of the handle 12 while maintaining connection to top portions 41G and 41H. As a result, the first bridges 29G and 29H are sheared off from the end portions 27G and 27H and the engaging portions 40G and 40H detach from the cover unit 20B.

8 Claims, 11 Drawing Sheets

U.S. PATENT DOCUMENTS

| | | | | | |
|---|---|---|---|---|---|
| 4,942,974 | A | * | 7/1990 | Larrison | 220/214 |
| 4,974,735 | A | * | 12/1990 | Newell et al. | 215/253 |
| 4,986,414 | A | * | 1/1991 | Ashley et al. | 206/5.1 |
| 5,238,134 | A | * | 8/1993 | Knapp | 220/266 |
| 5,657,506 | A | * | 8/1997 | Pankow | 15/104.92 |
| 5,979,691 | A | * | 11/1999 | Von Holdt | 220/266 |
| 6,138,312 | A | | 10/2000 | Cummings | |
| 6,213,330 | B1 | * | 4/2001 | Rufo et al. | 220/266 |
| 6,280,530 | B1 | | 8/2001 | Pankow | |

FOREIGN PATENT DOCUMENTS

| | | | |
|---|---|---|---|
| EP | 1092645 | A1 | 4/2001 |
| JP | 61-196966 | A | 12/1986 |
| JP | 1139413 | | 4/2002 |
| JP | 2002-142838 | | 5/2002 |
| JP | 2002-306227 | | 10/2002 |

OTHER PUBLICATIONS

Japanese Office Action dated Feb. 1, 2005 from corresponding Japaneses Application No. 2002-292407 (English translation enclosed).

* cited by examiner

CONTACT LENS CARRYING CASE

BACKGROUND OF THE INVENTION

1. Field of the Invention

The present invention pertains to a contact lens carrying case, and more particularly to a so-called disposable-type carrying case that is discarded once the contact lenses contained therein are removed.

2. Description of the Related Art

In recent years, a so-called disposable-type carrying case has been proposed as a container for housing contact lenses. With this type of disposable-type carrying case, the interior of the case is maintained in a sterile state when new, and the case is discarded after it is used for storing or cleaning the contact lenses. When this type of carrying case is used, the contact lenses are always stored in the sterile interior of the case. Consequently, the carrying case need not be cleaned each time the contact lenses are to be stored or cleaned therein, and the contact lenses can be stored and cleaned in a clean environment.

In order to reliably prevent the user from reusing this type of disposable carrying case, it must be made impossible to seal the case once it has been opened and the contact lenses removed. Accordingly, a method has been proposed in the conventional art whereby the lens housing areas of the case interior are covered by a film, which is affixed to the case main units using an adhesive. This method employs the principle that once the film is removed, the adhesive power of the adhesive weakens due to exposure to the air, thereby preventing the lens housing areas that were covered by the film from being re-sealed. (See, for example, Japanese Patent Laid-Open 2002-142838.)

However, with the conventional method in which the case is sealed using an adhesive, the adhesive can adhere to the fingers when the user attempts to remove the contact lenses, making the case difficult to handle.

A disposable-type carrying case is sometimes marketed as a product together with so-called 'disposable contact lenses' intended for only one day's use, with the lens storage solution already present in the carrying case. In this case, a process whereby the film is affixed to the case main units must be carried out during the product manufacturing stage, and during this affixation process, in order to ensure that the contact lenses remain sealed in the case, the degree of adhesion of the film (for example, the existence of areas of the film that are not adhering to the case main units) must be monitored strictly, which is inconvenient from a manufacturing standpoint.

In addition, no design has yet been proposed for a conventional disposable-type carrying case that reliably prevents the lens housing areas from being resealed using a method other than adhesion.

Accordingly, with the foregoing in view, an object of the present invention is to resolve the problems described above and to realize, via an easy-to-use construction, a disposable-type carrying case in which the lens housing areas cannot be re-closed.

SUMMARY OF THE INVENTION

The present invention is the contact lens carrying case which is discarded, once the seal on a housing area that houses contact lens is broken and the contact lens is removed from the housing area, the contact lens carrying case comprising: a case main unit that includes a housing unit in which is formed the housing area, and a cover unit that seals the housing area by being mounted to the housing unit; and a resealing prevention means that prevents each housing area from being resealed by the cover unit, once the housing area is no longer in a sealed state, wherein the resealing means constitutes means that prevents each housing area from being resealed by the cover unit by irreversibly changing the configuration of the case main unit when the sealed state is lost.

Here, an 'irreversible change' means a change that cannot be undone in order to return to the previous state.

According to the contact lens carrying case described above, the configuration of the case main unit is irreversibly changed when the sealed state of the housing areas is lost. Resealing of the housing area by the cover unit is prevented by this irreversible change. Therefore, a non-reusable disposable-type carrying case can be realized via an easy-to-handle construction, and the ease of use of the carrying case can be increased while maintaining the case interior in a hygienic state.

Such an irreversible change in the configuration of the case main unit may consist of the removal of a part of the members comprising the case main unit from the cover unit or the housing unit, or a change in the configuration of the part of the members comprising the case main unit, for example. In the first example, a construction may be adopted in which a part of the members removed from the cover unit may be left on part of the case main unit other than the cover unit, or in which the part of the members removed from the housing unit may be left on part of the case main unit other than the housing unit. Either construction would prevent the removed member from being misplaced or lost.

It is preferred that the housing unit have as housing area a first housing area that houses the contact lens for the left eye and a second housing area that houses the contact lens for the right eye. Such a construction enables a pair of contact lenses to be housed in a single case, and makes the carrying case even easier to handle.

It is also preferred, from the standpoint of ease of handling of the cover, that both the first housing area and the second housing area be sealed using a single cover unit.

It is acceptable if the cover unit seals the housing area by engaging with the housing unit, and if the resealing prevention means prevents the resealing of the housing area via the cover unit by irreversibly changing the configuration of at least one of the cover unit and the housing unit when the cover unit and the housing unit are no longer engaged.

Furthermore, a clamping unit that clamps together the housing unit and the cover unit affixed to the housing unit may be adopted as means to maintain the housing area in a sealed state, and the resealing prevention means may constitute means that prevents resealing of the housing area by irreversibly changing the configuration of the clamping unit and at least one of the cover unit and the housing unit when the clamping unit is no longer in the clamped position.

DESCRIPTION OF THE PREFERRED EMBODIMENTS

Figure 1:
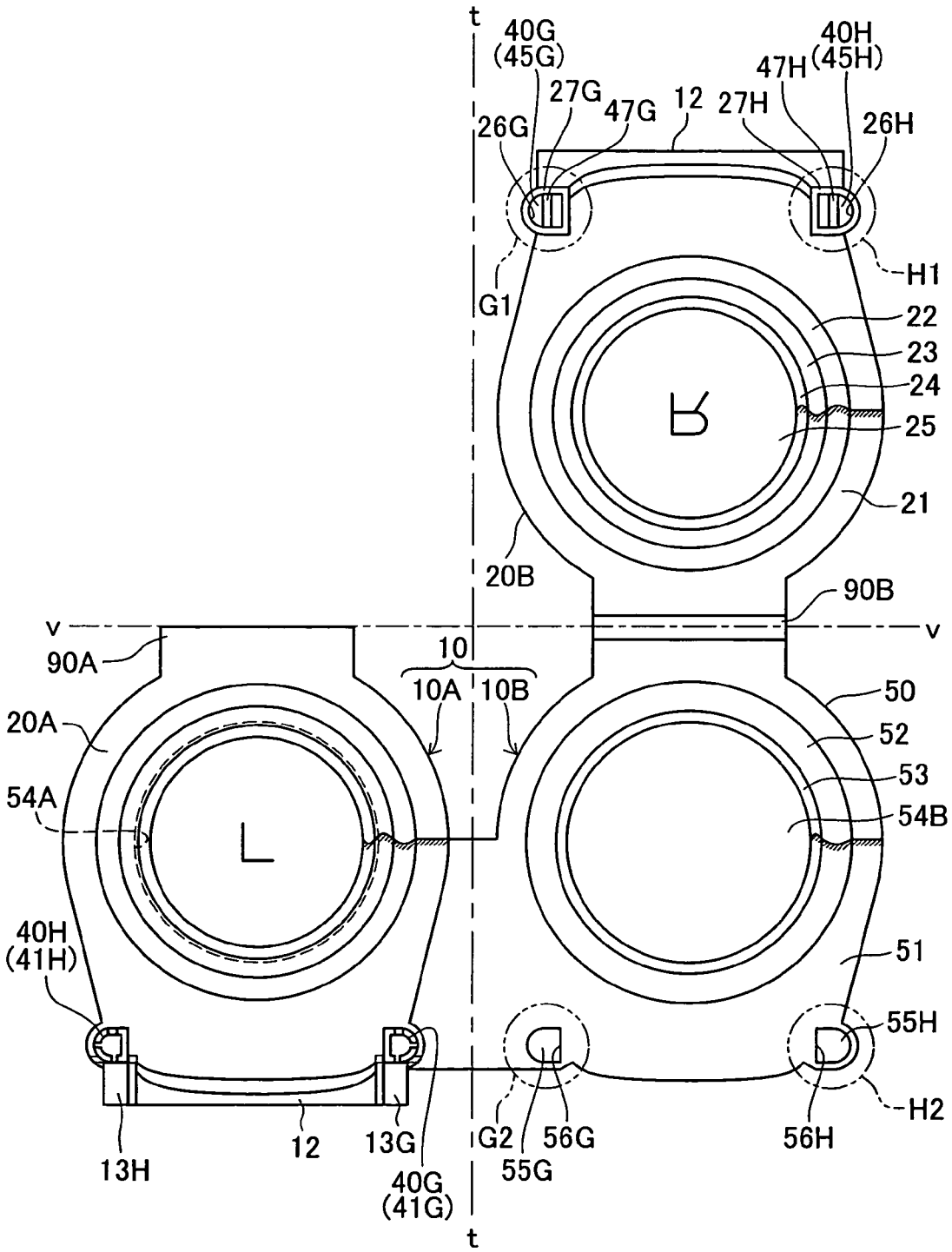
FIG. 1 is an explanatory drawing showing a plan view of a contact lens case 10 constituting a first embodiment of the present invention.
Figure 2A:
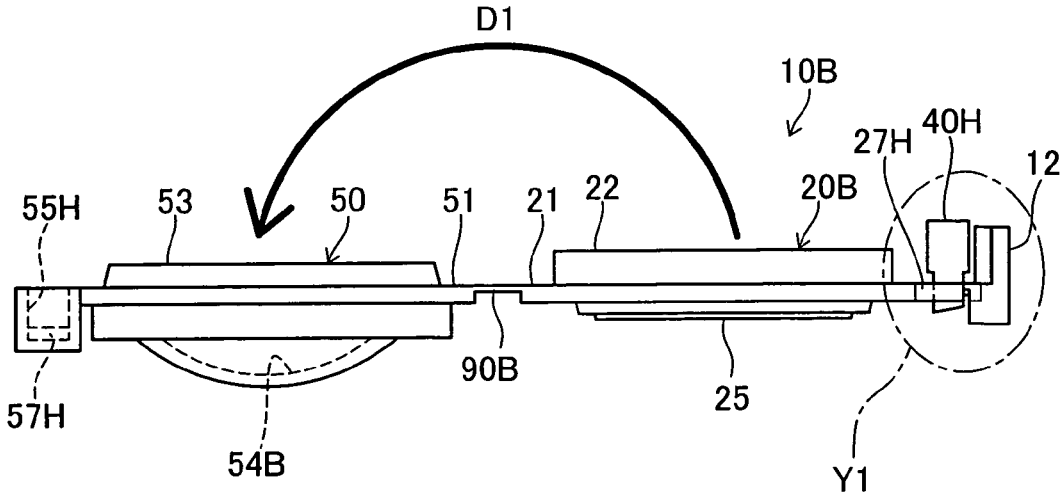
FIG. 2A shows a side view of the contact lens case 10 before sealing.

In order to further clarify the construction and operation of the present invention described above, embodiments of the present invention will be described below with reference to specific examples thereof. FIG. 1 is an explanatory drawing showing a plan view of a contact lens case 10 constituting a first embodiment of the present invention, while FIG. 2A is an explanatory drawing showing a side view of the contact lens case 10. This contact lens case 10 is a so-called disposable-type carrying case wherein the cover units 20A and 20B cannot be re-closed once they are opened from the closed state.

As shown in FIG. 1, the contact lens case 10 includes a case main unit 10A that houses the contact lens for the left eye and a case main unit 10B that houses the contact lens for the right eye. The case main units 10A and 10B share a common housing unit 50. As a result, the case main unit 10A is integrally formed with the case main unit 10B.

As shown in FIGS. 1 and 2, housing concavities 54A and 54B that constitute semi-spherical bowl-shaped concavities are formed side by side in the housing unit 50. The left contact lens and right contact lens are housed in these housing concavities 54A and 54B, respectively, together with storage solution or cleaning solution.

Covers 20A and 20B are mounted to the housing unit 50 via folding strips 90A and 90B, respectively. The letters 'L' and 'R' are affixed to these covers 20A and 20B, respectively, to indicate that the associated contact lens is intended for the left or right eye. The folding strip 90A and cover 20A, as well as the folding strip 90B and cover unit 20B, are integrally formed with the housing unit 50.

The cover units 20A and 20B are formed such that when they are folded over along the v-v line shown in FIG. 1 and rotated approximately 180° in the direction of the arrow D1 shown in FIG. 2A, they cover the housing concavities 54A and 54B, respectively. The bent areas of the folding strips 90A and 90B are thinner than the housing unit 50.

Figure 2B:
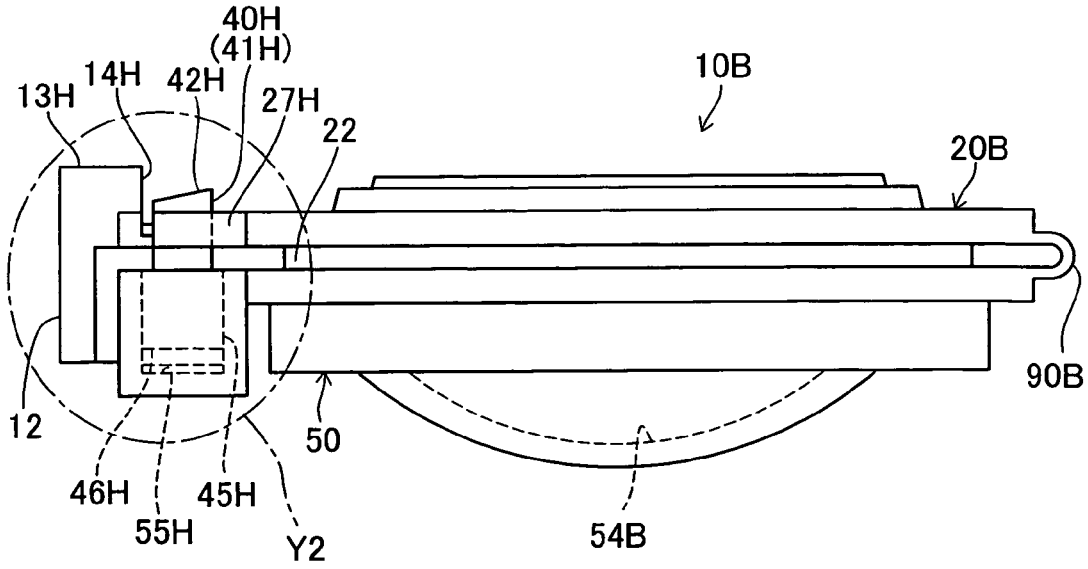
FIG. 2B shows a side view of the contact lens case 10 after sealing.

The cover units 20A and 20B that are rotated in this fashion are fastened in the closed position by fastening mechanisms SJ described below. As a result, the housing concavities 54A and 54B are sealed (hereinafter referred to as the 'sealed state') by the cover units 20A and 20B, respectively. FIG. 2B shows the case main unit 10B in the sealed state.

While the housing concavities 54A and 54B are in the sealed state, opening the cover units 20A and 20B causes this sealed state to be broken via the breaking mechanisms TJ described below. The contact lens case 10 as to which the sealed state has been broken has a non-resealable construction in order to prevent contamination of the case due to repeated use, and is discarded after the left and right contact lenses are removed from the housing concavities 54A and 54B.

FIG. 1 shows the case main unit 10B before it has ever been used (hereinafter the 'unused state') and the case main unit 10A in the sealed state. Where both the case main unit 10A and the case main unit 10B are in the unused state, the [contact lens case 10] is formed in the configuration bisected by the t-t line in FIG. 1. Consequently, the case main units 10A and 10B have essentially the same components. Therefore, in the description of the components of the case main units 10A and 10B below, in principle the case main unit 10B will be used as a representative example. Moreover, in FIGS. 1 and 2, identical symbols will be used to indicate components that are common to both the case main unit 10A and the case main unit 10B.

As shown in FIG. 1, a protrusion 53 is formed on the housing unit 50 on the side of the case main unit 10B such that it protrudes upward relative to the inner circumferential wall of the housing concavity 54B (i.e., the direction in which the closed cover unit 20B is located relative to the housing unit 50, hereinafter referred to as 'upward' or the 'top') (see FIGS. 2A and 2B). A circumferential groove 52 is formed between this protrusion 53 and the surface 51 of the housing unit 50. At the same time, a cover member 25 that faces the housing concavity 54B when the cover unit 20B is closed is formed on the cover unit 20B of the case main unit 10B, as is a protrusion 24 that protrudes downward relative to the inner circumferential wall of the cover member 20B (i.e., the direction in which the housing unit 50 is located relative to the closed cover unit 20B, hereinafter referred to as 'downward' or the 'bottom'). A circumferential groove 23 and protrusion 22 are formed in this order between this protrusion 24 and the surface 21 of the cover unit 20B.

Beginning from the situation shown in FIG. 2A, where the case main unit 10B is in the unused state, if the cover unit 20B is closed in the direction of the arrow D1 so as to cover the housing concavity 54B, the protrusion 24 disposed on the side of the cover unit 20B enters the interior of the housing concavity 54B along the inner circumferential wall of the housing concavity 54B. As a result, the housing concavity 54B is covered by the cover member 25. When the cover unit 20B is thereafter completely shut, the protrusion 53 disposed on the side of the housing unit 50 becomes snugly engaged with the circumferential groove 23 disposed on the outer circumference of the protrusion 24, and the protrusion 22 disposed on the side of the cover unit 20B becomes snugly engaged with the circumferential groove 52 disposed on the outer circumference of the protrusion 53. The housing concavity 54B is maintained in an airtight condition by the tight fit between the protrusions and grooves described above. When the cover units 20A and 20B are thereafter closed using the fastening mechanisms SJ composed of engaging members 40G and 40H, concave areas 55G and 55H and the like, the housing concavity 54B enters the sealed state shown in FIG. 2B.

As shown in FIGS. 1 and 2, the case main unit 10B includes a handle 12 that is integrally formed with the end portions 27G and 27H of the cover unit 20B. Fastening mechanisms SJ that maintain the closed state of the cover unit 20B and breaking mechanisms TJ that break the closed state of the cover unit 20B are disposed in the regions around the handle 12 and the end portions 27G and 27H (the regions G1 and H1 shown in FIG. 1) and the regions on the side of the housing unit 50 facing the end portions 27G and 27H of the closed cover unit 20B (the regions G2 and H2 shown in FIG. 1).

The fastening mechanisms SJ and breaking mechanisms TJ are disposed at two locations, i.e., on the inside (the areas G1 and G2 in FIG. 1, on the side nearer to the other case main unit 10A) and the outside (the areas H1 and H2 in FIG. 1, on the side farther from the other case main unit 10A). In this embodiment, the constituent parts of the fastening mechanism SJ and the breaking mechanism TJ that are disposed on the former side (the inside) are indicated by the symbol 'G' at the end, while the constituent parts of the fastening mechanism SJ and the breaking mechanism TJ that are disposed on the latter side (the outside) are indicated by the symbol 'H' at the end. The fastening mechanisms SJ and breaking mechanisms TJ disposed at the two different locations have essentially the same constructions and functions. Therefore, in the description below, in principle the fastening mechanism SJ and breaking mechanism TJ disposed on the outside of the case main unit 10B will be described as representative examples.

Figure 3:
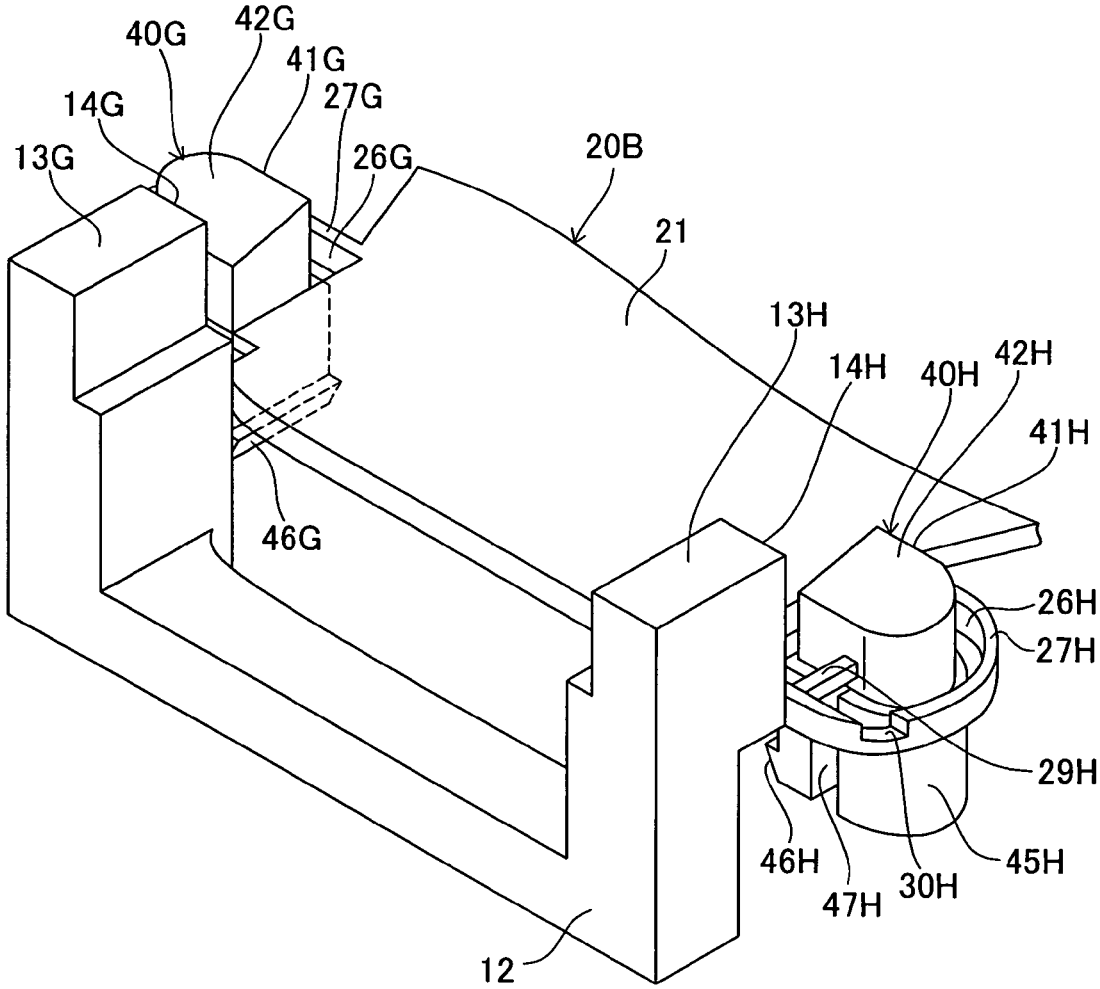
FIG. 3 is a perspective view showing the components disposed around the end portions 27G and 27H of the cover unit 20B that is integrally formed with a handle 12.
Figure 4:
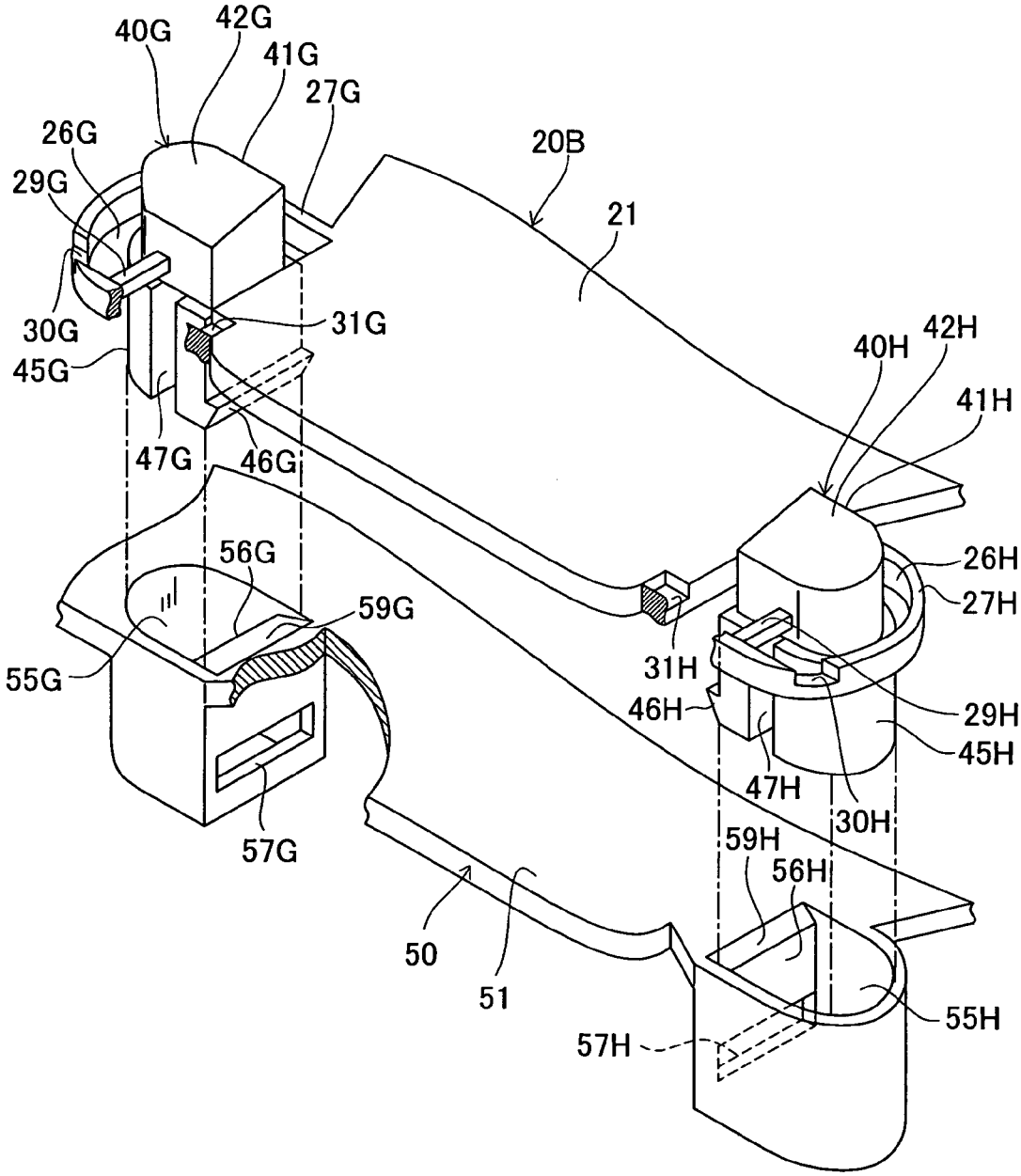
FIG. 4 is a perspective view showing the components by which the cover unit 20B engages with the housing unit 50.

The various constituent parts of the fastening mechanism SJ and the breaking mechanism TJ will be described with reference to FIGS. 3 and 4. FIG. 3 is an explanatory drawing showing a perspective view of the components disposed around the end portions 27G and 27H of the cover unit 20B with which the handle 12 is integrally formed, while FIG. 4 is an explanatory drawing showing a perspective view of the components by which the cover unit 20B is fastened to the housing unit 50. In FIG. 4, the fastening components are shown with the handle 12 of the cover unit 10B removed in order to make the construction of such components easier to understand.

As shown in FIG. 3, openings 26G and 26H are formed in the end portions 27G and 27H of the cover unit 20B, and engaging members 40G and 40H are disposed inside these openings 26G and 26H, respectively. These engaging members 40G and 40H are composed of top portions 41G and 41H and bottom portions 45G and 45H.

The top surfaces 42G and 42H of the top portions 41G and 41H protrude upward above the end portions 27G and 27H. The top surfaces 42G and 42H slant downward so as to face in the direction of the handle 12.

The top portions 41G and 41H are fixed via first bridges 29G and 29H to the inner circumferential walls of the end portions 27G and 27H in which the openings 26G and 26H are formed.

The bottom portions 45G and 45H have an external configuration that is slightly larger than that of the top portions 41G and 41H, and extend downward from the bottom surfaces of the top portions 41G and 41H. The bottom portions 45G and 45H are each divided into two members, i.e., an inner side (the side closer to the surface 21 of the cover unit 20B) and an outer side (the side farther from the surface 21 of the cover unit 20B), by slits 47G and 47H formed in the center thereof, and engaging pieces 46G and 46H are formed on the inner side members.

As shown in FIGS. 3 and 4, an outer notch 30H and an inner notch 31H are formed on the end portion 27H disposed between the engaging member 40H and the handle 12 by eliminating sections of the top surface thereof. These notches 30H and 31H are formed along an axial line parallel to the axis of rotation of the handle 12. In addition, an outer notch 30G and inner notch 31G similar to the notches described above are formed in the end portion 27G disposed between the engaging member 40G and the handle 12.

As shown in FIG. 4, concave areas 55G and 55H are disposed at positions on the housing unit 50 that face the bottom portions 45G and 45H when the cover unit 20B is closed. These concave areas 55G and 55H are large enough to house the bottom portions 45G and 45H. Furthermore, through-holes 57G and 57H that are large enough to permit engagement with the engaging pieces 46G and 46H are formed on the inner sides of the concave areas 55G and 55H (the side of each that is nearer to the other concave area 55H or 55G). In addition, slopes 59G and 59H are formed in the concave areas 55G and 55H at positions at which they face the engaging pieces 46G and 46H when the cover unit 20B is closed.

Figure 5:
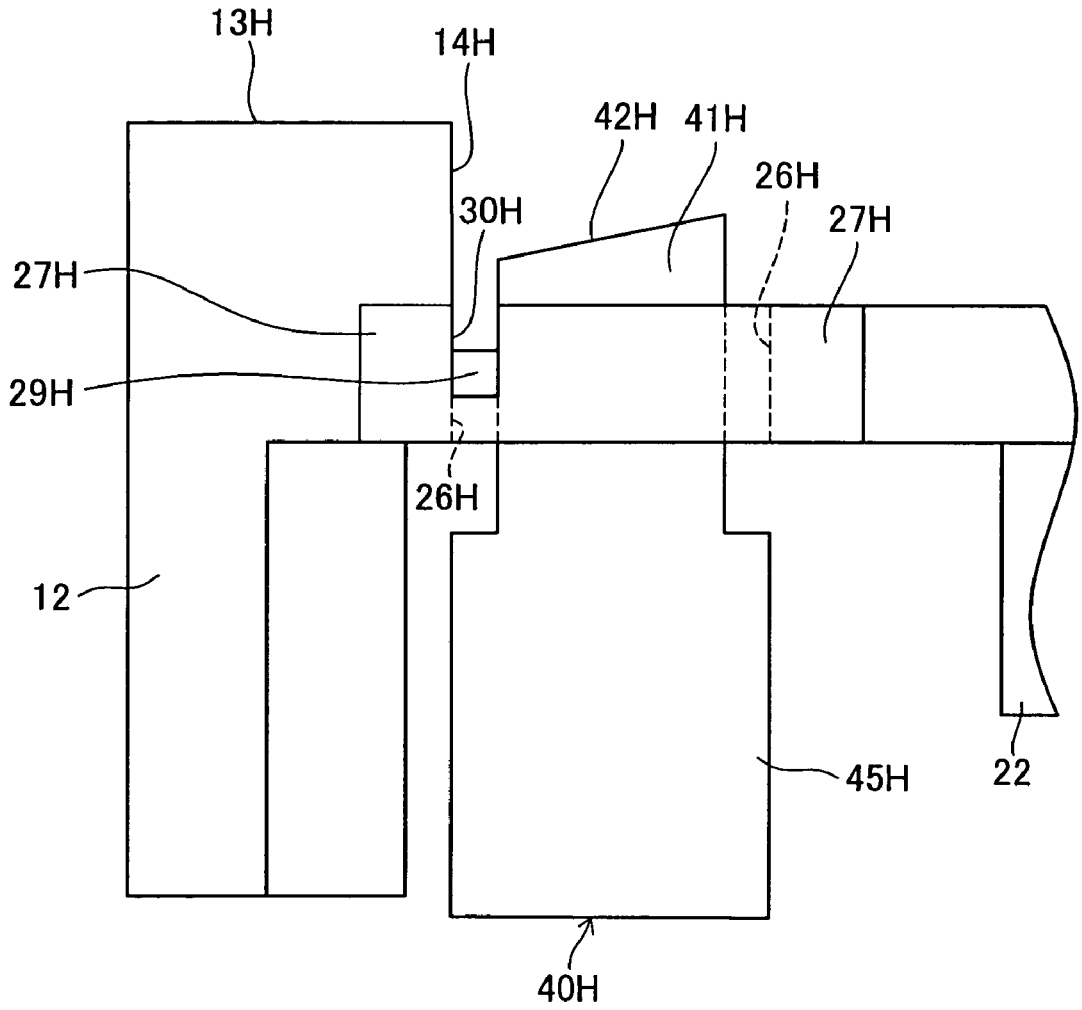
FIG. 5 is an explanatory drawing showing an expanded inverted view of the important components in FIG. 2A.

The construction of the handle 12 will now be explained with reference to FIGS. 3 and 5. FIG. 5 is an explanatory drawing showing an enlarged view of the important components Y1 in FIG. 2A rotated 180° vertically. As shown in these figures, when the handle 12 is mounted to the end portions 27G and 27H, the top surfaces 13G and 13H are higher than the top surfaces 42G and 42H of the engaging members 40G and 40H. The height of these top surfaces 13G and 13H is set at the height at which the walls 14G and 14H that face the engaging members 40G and 40H come into contact with the top surfaces 42G and 42H when the handle 12 rotates in the direction of the engaging members 40G and 40H around an axis consisting of the line that connects the outer notches 30G and 30H and the inner notches 31G and 31H of the end portions 27G and 27H.

Figure 6:
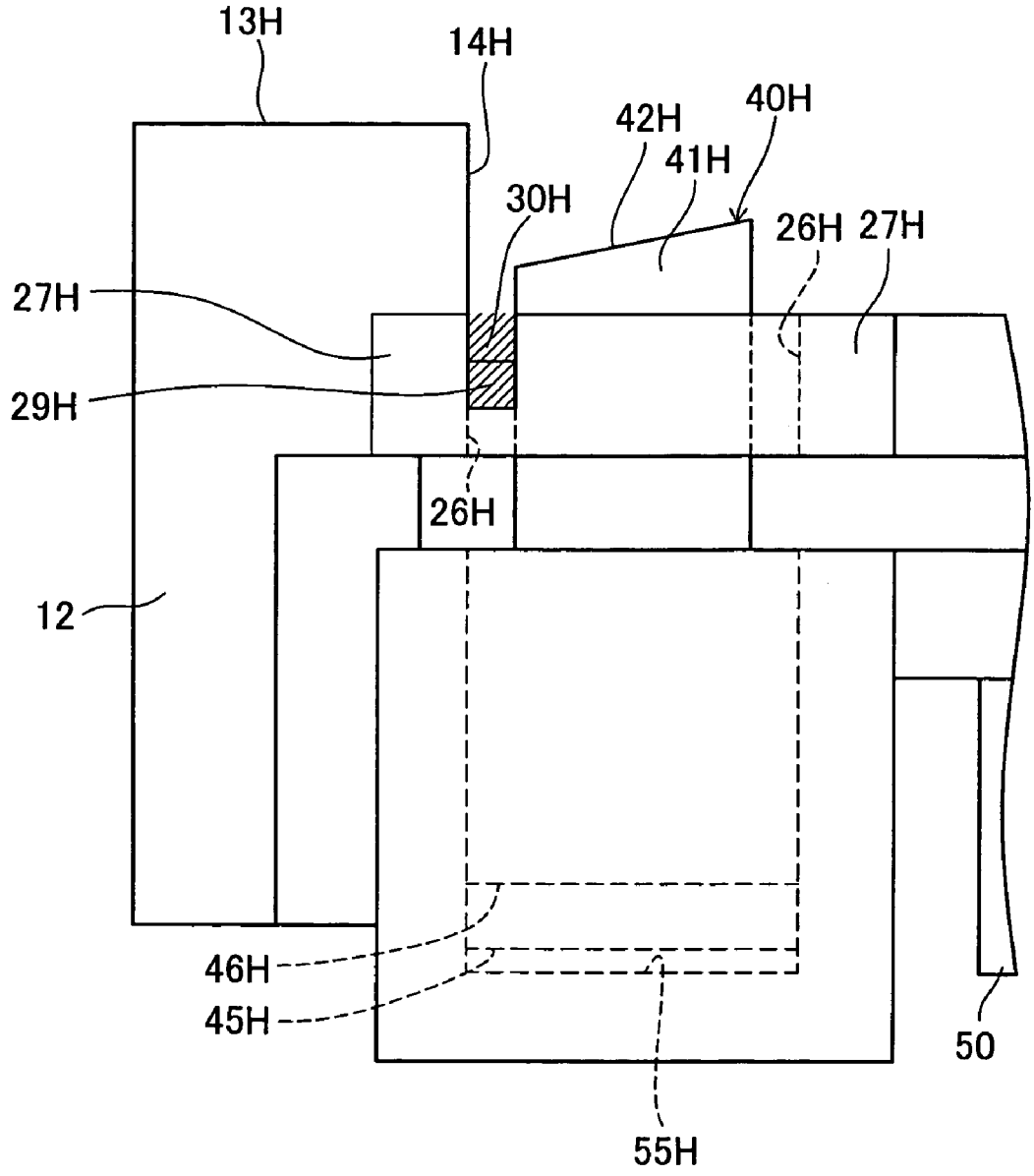
FIG. 6 is an explanatory drawing showing an expanded view of the important components in FIG. 2B.

In the contact lens case 10 having the construction described above, the fastening mechanisms SJ are composed of the engaging members 40G and 40H disposed on the side of the cover unit 20B and the concave areas 55G and 55H having the through-holes 57G and 57H that are disposed on the side of the housing unit 50. In other words, when the cover unit 20B is closed, the bottom portions 45G and 45H of the engaging members 40G and 40H disposed on the side of the cover unit 20B enter the concave areas 55G and 55H on the side of the housing unit 50. When this occurs, because the engaging pieces 46G and 46H that come into contact with the slopes 59G and 59H are guided by the slanted surfaces thereof to enter the concave areas 55G and 55H, they are smoothly and reliably led toward the interior of the concave areas 55G and 55H. When the cover unit 20B is then closed, the engaging pieces 46G and 46H advance toward the bottom surfaces of the concave areas 55G and 55H while warping toward the slits 47G and 47H due to the contact with the inner walls 56G and 56H, and enter the through-holes 57G and 57H due to elastic force at the time that they reach the positions at which the through-holes 57G and 57H are formed. This causes the engaging pieces 40G and 40H on the side of the cover unit 20B to engage with the concave areas 55G and 55H on the side of the housing unit 50, maintaining the cover unit 20B in the closed state. This engaged state is shown in FIG. 6. FIG. 6 shows an enlarged view of the key components Y2 in FIG. 2B. In addition, when the cover unit 20B is in the closed state, a sufficient clearance is maintained after engagement between the bottommost parts of the bottom portions 45G and 45H and the inner bottom surfaces of the concave areas 55G and 55H.

At the same time, the breaking mechanisms TJ are composed of engaging members 40G and 40H that are engaged with the concave areas 55G and 55H, end portions 27G and 27H that are connected to these engaging members 40G and 40H via first bridges 29G and 29H, and the handle 12. The functions of these various components are explained with reference to FIGS. 6 through 9.

Figure 7:
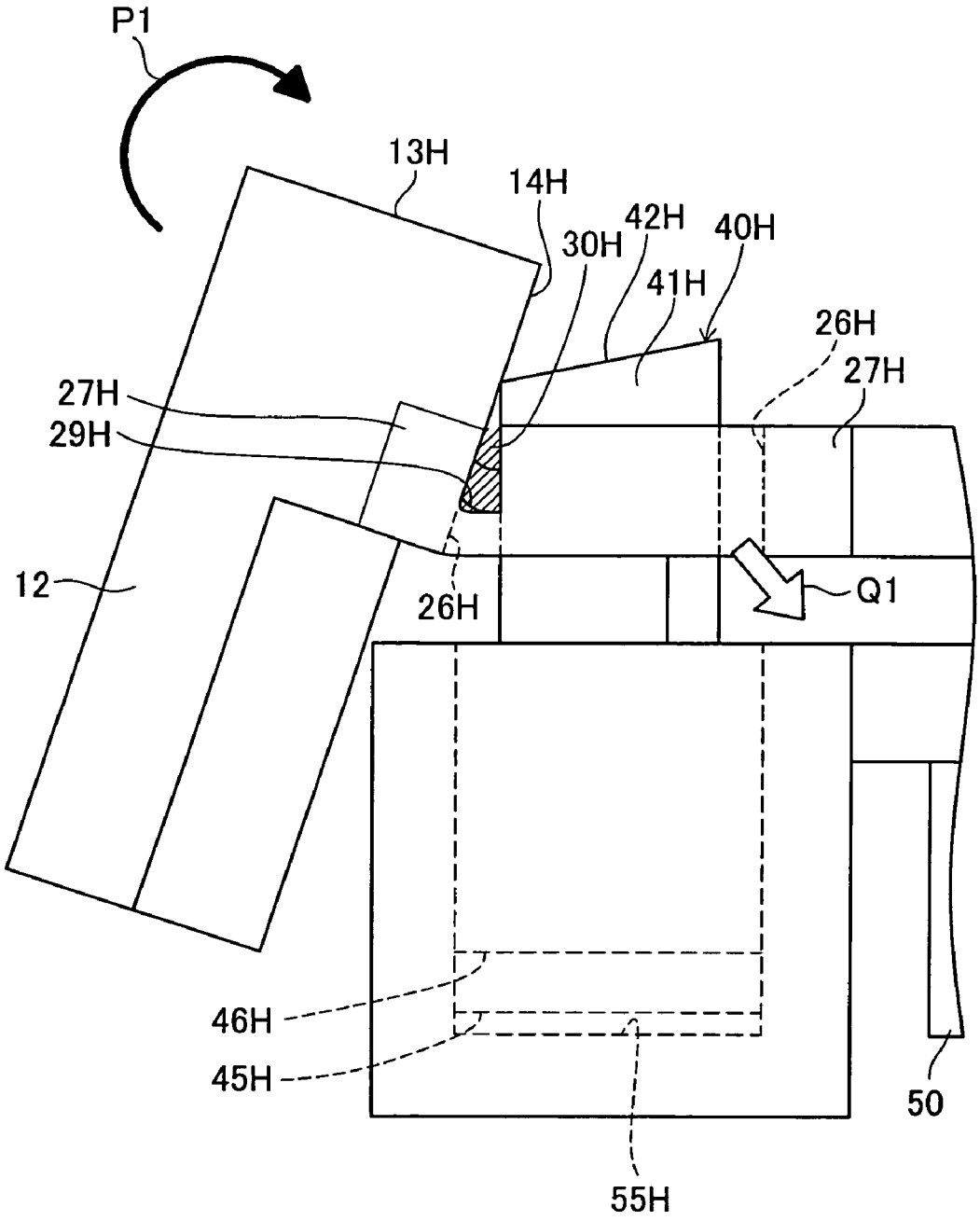
FIG. 7 shows the handle 12 of the case main unit 10B in the sealed state when it is rotated in the direction of the arrow P1.

In the state shown in FIG. 6 (the state in which the engaging members 40G and 40H are engaged with the concave areas 55G and 55H), when the handle 12 is lifted upward in the clockwise direction, the handle 12 rotates in the direction of the arrow P1 around an axis consisting of the line that connects the outer notches 30G and 30H and the inner notches 31G and 31H of the end portions 27G and 27H, as shown in FIG. 7. As a result of this rotation of the handle 12, the first bridges 29G and 20H that link the end portions 27G and 27H with the top portions 41G and 41H of the engaging members 40G and 40H is pulled upward in the direction of rotation of the handle 12, and the walls 14G and 14H of the handle 12 come into contact with the foot areas (the bottommost portions of the downward slanting surfaces) of the top surfaces 42G and 42H of the engaging members 40G and 40H.

In FIGS. 6 through 9, because the outer notch 30G and the inner notches 31G and 31H are positioned directly behind the outer notch 30H, they are omitted from the figures. Furthermore, in FIGS. 6 through 8, the hollowed-out area formed in the outer notch 30H is indicated by diagonal lines.

In the state shown in FIG. 7 (the state in which the top surfaces 42G and 42H are in contact with the walls 14G and 14H), when the handle 12 is further lifted upward in the clockwise direction, the handle 12 rotates in the direction of the arrow P1 while pressing diagonally downward in the direction opposite from the handle 12 (in the direction of the arrow Q1 in FIG. 7) against the top portions 41G and 41H of the engaging members 40G and 40H via the walls 14G and 14H.

Figure 8:
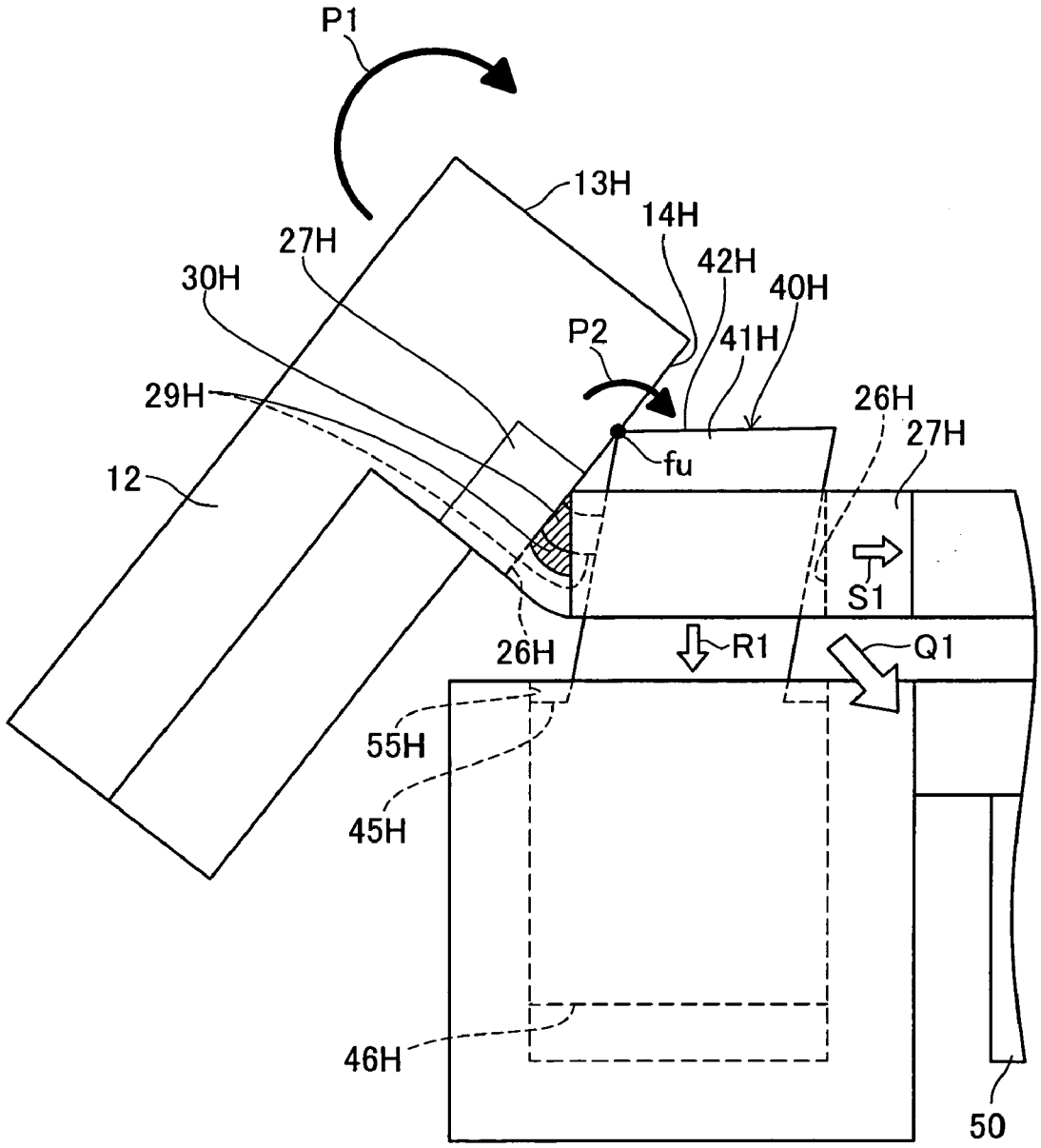
FIG. 8 shows the rotation of the handle 12 while pressure is applied to the top portions 41G and 41H.

The rotation of the handle 12 while pressure is applied against the top portions 41G and 41H is shown in FIG. 8. As shown in FIG. 8, the diagonal downward pressure on the top portions 41G and 41H causes the engaging members 40G and 40H to move downward (in the direction of the arrow R1 in FIG. 8) within the concave areas 55G and 55H, whereby the bottommost parts of the bottom portions 45G and 45H come into contact with the inner bottom surfaces of the concave areas 55G and 55H. As a result, the engaging members 40G and 40H can no longer move within the concave areas 55G and 55H in the direction of the arrow R1.

In addition, the diagonal downward pressure exerted on the top portions 41G and 41H causes the engaging members 40G and 40H to move horizontally within the openings 26G and 26H of the end portions 27G and 27H in the direction away from the handle 12 (in the direction of the arrow S1 in FIG. 8), whereby the top portions 41G and 41H of the engaging members 40G and 40H come into contact with the end portions 27G and 27H on the side at which the first bridges 29G and 29H are not formed. As a result, the engaging members 40G and 40H can no longer move in the direction of the arrow S1 within the openings 26G and 26H.

The rotation of the handle 12 that results in this movement of the engaging members 40G and 40H further causes the first bridges 29G and 29H to be lifted upward in the direction of rotation of the handle 12.

During the state shown in FIG. 8 (the state in which the engaging members 40G and 40H cannot move in the direction of the arrows R1 and S1), if the handle 12 is pulled upward in the clockwise direction with force, the handle 12 rotates in the direction of the arrow P2 using as a fulcrum the contact point 'fu' disposed between the walls 14G and 14H and the top surfaces 42G and 42H. This rotation of the handle 12 in the direction of the arrow P2 while the engaging members 40G and 40H are fixed in position causes the end portions 27G and 27H that are integrally formed with the handle 12 to rise gradually starting with the parts close to the handle 12. As a result, the first bridges 29G and 29H connected to the parts of the end portions 27G and 27H that are close to the handle 12 are pulled with force in the direction of the arrow P2 while the connection with the top portions 41G and 41H is maintained, resulting in the application of a shearing force to the first bridges 29G and 29H. This shearing force increases in strength as the rotation of the handle 12 in the direction of the arrow P2 progresses, and within a short amount of time the first bridges 29G and 29H are sheared off from the end portions 27G and 27H.

Due to the shearing of the first bridges 29G and 29H, the cover unit 20B detaches from the engaging members 40G and 40H. As a result, the handle 12 can be further rotated in the direction of the arrow P2 and the cover unit 20B can be opened, thereby allowing the contact lenses to be removed from the housing concavities 54A and 54B.

Figure 9:
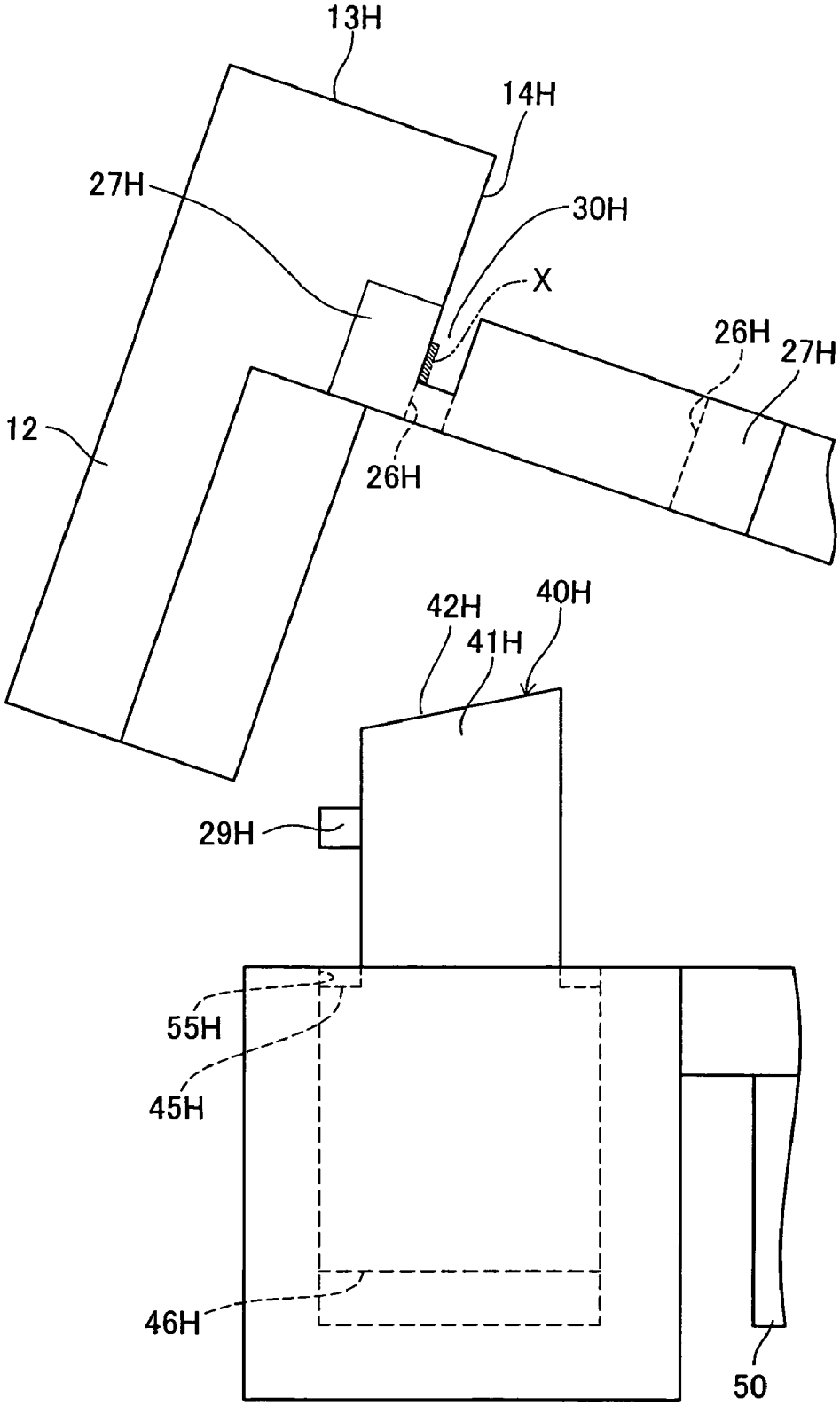
FIG. 9 shows the state in which an engaging member 40H is detached from the end portion 27H of the cover unit 20B.

The detachment of the engaging member 40H from the cover unit 20B is shown in FIG. 9. As shown in FIG. 9, the first bridge 29H connected to the end portion 27H of the cover unit 20B is sheared off at the region X. The engaging member 40H that is detached from the cover unit 20B due to this shearing is held on the side of the housing unit 50 while engaging with the concave area 55H. The first bridge 29H remains on the surface of this held engaging member 40H after shearing occurs. As a result of the shearing of the first bridge 29H as described above, the cover unit 20B cannot be returned to its original configuration (i.e., its configuration when the engaging member 40H was connected to the end portion 27H).

Even where the cover unit 20B is closed from the state shown in FIG. 9 (the state in which the engaging member 40H has detached from the end portion 27H of the cover unit 20B), because there is no member that keeps the cover unit 20B fastened to the housing unit 50 (i.e., the engaging member 40H), the cover unit 20B cannot be maintained in the closed state. As a result, the housing concavity 54B can no longer be resealed by the cover unit 20B.

According to the contact lens case 10 of the first embodiment described above, where the sealed state of the housing concavity 54B realized via the closing of the cover unit 20B is broken by the opening of the cover unit 20B, the engaging members 40G and 40H detach from the cover unit 20B due to the breaking of this sealed state. The resealing of the housing concavity 54B by the cover unit 20B is prevented by the detachment of the engaging members 40G and 40H. Therefore, a non-reusable disposable-type carrying case can be realized via an easier-to-handle construction, and the convenience of the carrying case can be increased while maintaining the cleanliness of the carrying case. Furthermore, because the engaging members 40G and 40H that detach from the cover unit 20B remain inside the concave areas 55G and 55H of the housing unit 50, they can be prevented from becoming separated from the contact lens case 10 after they detach.

Moreover, according to the above contact lens case 10, the contact lenses that are inserted in the user's eyes can be stored in a safer condition. In other words, first, using the contact lens case 10 described above, the fastening mechanisms SJ disposed on the case main unit 10B are lost due to the opening of the cover unit 20B from the closed state. As a result, the user can readily determine from the state of the case main unit 10B after the cover unit 20B is opened (specifically, the state in which the cover unit 20B cannot be maintained in a closed state after it is opened) that the cover unit 10B cannot be reused. Therefore, a situation in which the case is mistakenly reused and the contact lenses are contaminated by microbes or the like can be reliably prevented.

Second, using the above contact lens case 10, it can be clearly seen based on the appearance of the case main unit 10B that the cover main unit 20B has been opened from the closed state. This is because due to the opening of the cover unit 10B from the closed state, the configuration of [the case main unit 10B] changes as a result of the detachment of the engaging members 40G and 40H from the cover unit 20B, thereby preventing the case main unit 10B from being returned to its state prior to the opening of the cover 20B. Therefore, the intentional insertion of foreign matter into the case main unit 10B in which the contact lens is housed can be prevented.

Figure 10A:
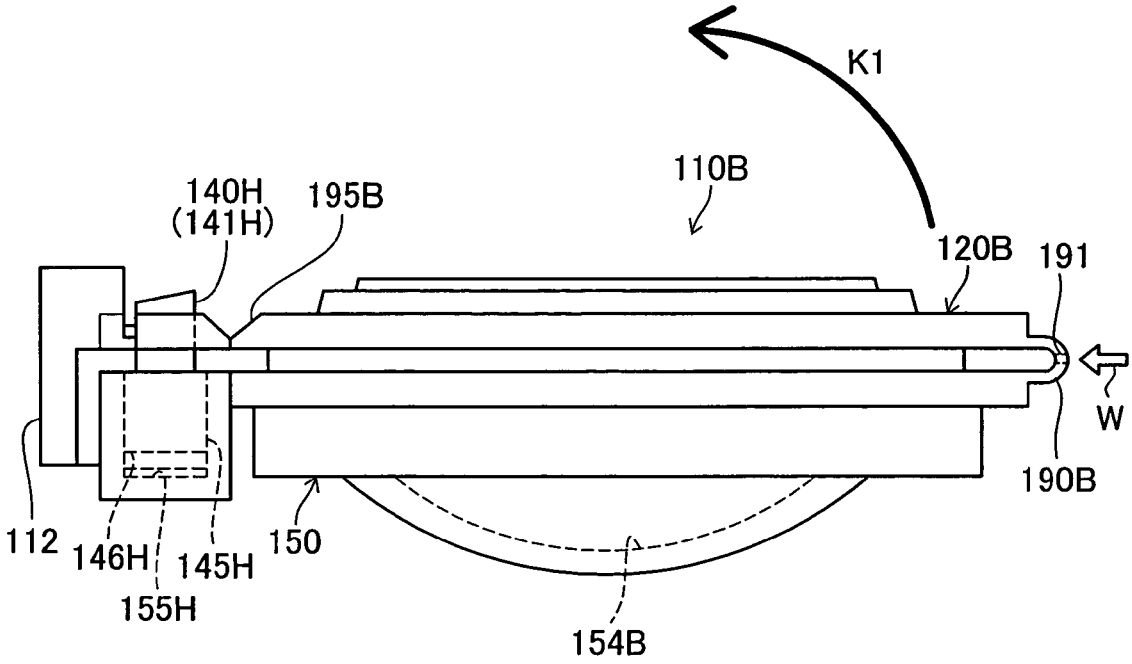
FIGS. 10A and 10B each show a side view of the contact lens case 10 constituting a second embodiment of the present invention from two different directions.

A different construction that combines cleanliness, convenience and safety as described above will be described below as a second embodiment. FIG. 10A is an explanatory drawing showing the side view of a contact lens case 110 constituting a second embodiment of the present invention. The contact lens case 110 shown in FIG. 10 includes essentially the same components as the contact lens case 10 of the first embodiment described above. In FIG. 10, these common components are indicated using in the tens and ones columns the same numbers and letters used in connection with the first embodiment above.

Figure 10B:
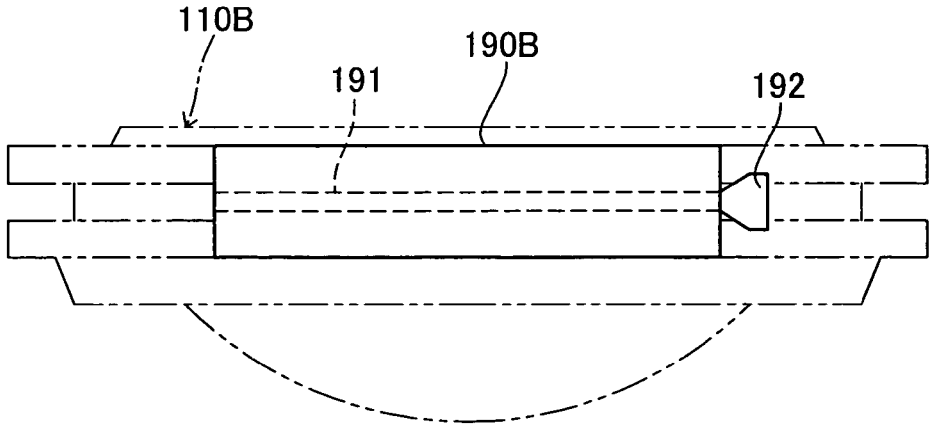

FIG. 10A is a side view equivalent to FIG. 2B, and shows case main units 110A and 110B in the state in which housing concavities 154A and 154B are sealed by cover units 120A and 120B that are bent via folding strips 190A and 190B. Because the folding strip 190A, cover unit 120A, housing concavity 154A and case main unit 110A are disposed behind the folding strip 190B, cover unit 120B, housing concavity 154B and case main unit 110B, they are not shown in the drawing. FIG. 10B is a side view of the folding strip 190B of the case main unit 110B shown in FIG. 10A as seen from the direction of the arrow W.

The contact lens case 110 of the second embodiment has, as in the first embodiment, fastening mechanisms SJ comprising the engaging members 140G and 140H that are disposed on the side of the cover unit 120B and engage inside the concavities 155G and 155H that are disposed on the side of the housing unit 50, such fastening mechanisms SH holding the cover unit 120B in the closed position. At the same time, the contact lens case 110 differs from the contact lens case 10 of the first embodiment in that the breaking mechanisms TJ that break the closed state of the cover units 120A and 120B are disposed on the folding strips 190A and 190B. In other words, as shown in FIG. 10B, a cutaway area 191 formed by notches on either side, as well as a pull tab 192 that is connected to this cutaway area 191 and is exposed to the outside of the case main unit 110B, are formed on the folding strip 190B of the case main unit 110B.

A V-shaped cutout 195B is cut out from the surface of the cover unit 120B near the engaging members 140G and 140H. This cutout 195B is cut out to form an obtuse angle such that its sides are parallel with the line connecting the engaging member 140G and the engaging member 140H, and is formed along the entire outer surface of the cover unit 120B. Similarly, a cutaway area, pull tab and cutout similar to those in the case main unit 110B are also formed in the folding strip 190A of the case main unit 110A and the cover unit 120A.

In the contact lens case 110 having the above construction, the cover units 120A and 120B are not opened from the side of the fastening mechanisms SJ, but from the side of the folding strips 190A and 190B. In other words, by pulling the pull tab 192 along the notches of the cutaway area 191, the cutaway area 191 is torn away from the folding strip 190B, causing the pull tab 192 and the cutaway area 191 to detach from the folding strip 190B. This permits the cover unit 120B to be opened in the direction of the arrow K1 shown in FIG. 10A using the cutout 195B as a rotational axis, allowing the contact lens to be removed from the housing concavity 154B.

In addition, the detachment of the pull tab 192 and the cutaway area 191 prevents the folding strip 190B from returning to its original configuration. Therefore, even where the cover unit 120B is closed after the detachment of the pull tab 192 and the cutaway area 191, the cover unit 120B cannot be maintained in the closed state, and consequently the housing concavity 154B cannot be resealed by the cover unit 120B.

According to the contact lens case 110 of the second embodiment described above, when the sealed state of the housing concavity 154B achieved via the closing of the cover unit 120B is broken, the pull tab 192 and the cutaway area 191 detach from the folding strip 190B as a result thereof. The detachment of the cutaway area 191 prevents the resealing of the housing concavity 154B by the cover unit 120B. Therefore, a non-reusable disposable-type carrying case can be realized using a construction that is easier to handle, and the convenience of the carrying case can be increased while maintaining the cleanliness thereof. Furthermore, as with the contact lens case 10 of the first embodiment described above, the contact lenses that are inserted in the user's eyes can be stored in a safer condition.

In the second embodiment described above, a construction having no handles 112 may be adopted, and it is acceptable if a different construction for the fastening mechanisms SJ is used.

While the present invention was explained with reference to embodiments, the present invention is not limited thereby, and may be implemented in any fashion within the essential scope of the invention. For example, the first embodiment used the construction in which the engaging members 40G and 40H remain in the concave areas 55G and 55H after detachment, but a construction in which the engaging members 40G and 40H do not remain in the case main units 10A and 10B after detachment may be adopted instead.

Figure 11:
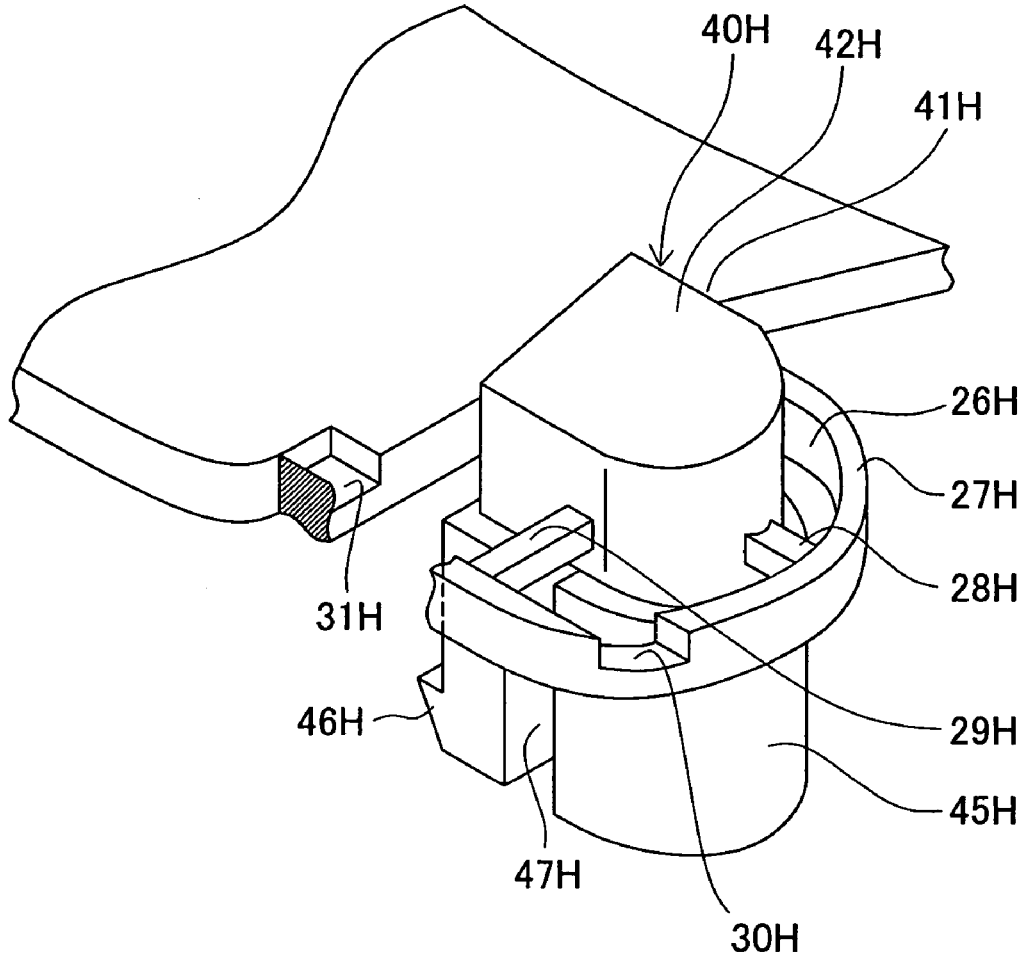
FIG. 11 is a perspective view showing the state in which the engaging member 40H is secured at two locations on the end portion 27H via two bridges, i.e., a first bridge 29H and a second bridge 28H.

In the above embodiments, the engaging members 40G and 40H were secured to the end portions 27G and 27H of the cover units 20A and 20B at a single location via the first bridges 29G and 29H, but they may be secured at two or more locations. An example in which the engaging member 40H is secured to the end portion 27H at two locations via a first bridge 29H and a second bridge 28H is shown in FIG. 11.

In the above embodiments, the engaging members 40G and 40H were disposed on the side of the cover units 20A and 20B, while the concave areas 55G and 55H were disposed on the side of the housing unit 50, but a construction may be adopted instead wherein the engaging members 40G and 40H are disposed on the side of the housing unit 50, while the housing concavities 54A and 54B are disposed on the side of the cover units 20A and 20B.

In the above embodiments, the case main unit 10A including the housing concavity 54A was integrally formed with the case main unit 10A including the housing concavity 54B, and the right and left contact lenses were housed as a pair in the contact lens case 10, but it is acceptable if a construction is adopted wherein the case main units 10A and 10B are separate, and the right and left contact lenses are housed in separate cases.

In the above embodiments, the housing concavities 54A and 54B were covered by two separate cover units 20A and 20B, but a construction may be adopted wherein both housing concavities 54A and 54B are covered by a single cover unit.

Furthermore, while the cover units 20A and 20B are integrally formed with the housing unit 50 in the above embodiments, a construction may be used wherein the cover units 20A and 20B are separate from the housing unit 50 and are mounted thereon in an interlocking fashion.

In the above embodiments, a handle 12 was used as means to break the fastening of the cover units 20A and 20B to the housing unit 50, but a construction may be adopted that does not use handles 12, but wherein the fastening of the cover units 20A and 20B is broken using a finger or nail. For example, in the case of the first embodiment described above, if a finger is inserted between the cover units 20A and 20B and the housing unit 50 of the contact lens case 10 during the closed state, and the end portions 27G and 27H of the cover units 20A and 20B are lifted upward, the engaging members 40G and 40H become detached from the cover units 20A and 20B and the cover units 20A and 20B can be opened.

In the above embodiments, non-resealable contact lens cases 10 and 110 were realized via the detachment of the engaging members 40G and 40H or the cutaway area 191, but a different type of irreversible change other than detachment may be used instead. For example, a construction may be adopted wherein the opening of the cover units 20A and 20B from the sealed state over the case main units 10A and 10B causes part of the case main units 10A and 10B to deform into a configuration that prevents resealing.

In the above embodiments, non-resealable contact lens cases 10 and 110 were realized via an irreversible change in the configuration of the cover units 20A and 20B or the folding strips 190A and 190B, but a non-resealable contact lens case may also be achieved via an irreversible change in the configuration of a part of the case main units 10A and 10B other than the cover units 20A and 20B or the folding strips 190A and 190B.

For example, in the first embodiment, it is acceptable if a construction is used for the fastening mechanisms SJ wherein, instead of the engaging members 40G and 40H and the concave areas 55G and 55H, engaging members belonging to the handles 12 become engaged with the housing unit 50 to keep the cover units 20A and 20B in the closed state, such that the engaging members of the handles 12 become detached from the handles 12 when the cover units 20A and 20B are opened.

In addition, it is also acceptable if a construction is used for the fastening mechanisms SJ wherein, instead of the engaging members 40G and 40H and the concave areas 55G and 55H, clamping units that clamp the housing unit 50 and the cover units 20A and 20B together are used to keep the cover units 20A and 20B in the closed state, such that when the clamping by the clamping units is eliminated, the configuration of the housing unit 50 or of the cover units 20A and 20B, which were clamped by the clamping units, changes due to partial detachment or deformation, thereby disabling re-clamping by the clamping units.

What is claimed is:

1. A contact lens carrying case which is discarded once the seal on a housing area that houses contact lens is broken and the contact lens is removed from the housing area, the contact lens carrying case comprising:

a contact lens case main unit that includes a housing unit comprising housing areas that include concavities arranged to house contact lenses, and including at least one cover unit that seals the lenses in the housing areas when the at least one cover unit is mounted to the housing unit; and a resealing prevention feature that prevents each housing area from being resealed by the cover units, once each housing area is no longer in a sealed state, wherein the resealing prevention feature prevents each housing area from being resealed by the cover unit by irreversibly changing the configuration of the case main unit when the sealed state is lost, wherein said irreversible change in the configuration of said case main unit is caused by the rotation of a handle component integral to the contact lens carrying case, said rotation of the handle effectuated while said cover unit remains closed thereby enabling the detachment of a portion of members comprising a part of said case main unit, said irreversible change comprising at least one of, a) detachment of the members from the at least one cover unit such that a portion of the members remain in a portion of the case main unit other than the at least one cover unit; or b) detachment of the members from the housing unit such that a portion of the members remain in a portion of the case main unit other than the housing unit.

2. The contact lens carrying case according to claim 1, wherein said irreversible change in the configuration of said case main unit includes the detachment of a part of the members comprising each of said case main unit from the cover unit or/and the housing unit.

3. The contact lens carrying case according to claim 1, wherein the part of the members that detach from said at least one cover unit remains in part of the case main unit other than the at least one cover unit.

4. The contact lens carrying case according to claim 1, wherein the part of the members that detach from said housing unit remains in part of the case main unit other than the housing unit.

5. The contact lens carrying case according to claim 1, wherein both the first housing area and the second housing area are sealed using a single cover unit.

6. The contact lens carrying case according to claim 1, wherein said at least one cover unit seals the housing area by engaging with the housing unit, and said resealing prevention feature constitutes a means for preventing the resealing of the housing area via the cover unit by irreversibly changing the configuration of at least one of the cover unit and the housing unit when the cover unit and the housing unit are no longer engaged.

7. A disposable contact lens carrying case comprising:

a case main unit including a cover unit and housing areas, the housing areas having concavities arranged to house contact lenses, and the cover unit arranged so that the cover unit seals the lenses in the concavities of the housing areas when the cover unit is mounted to the housing areas;

a resealing prevention feature that prevents each housing area from being resealed by the cover unit once the seal of a housing area has been broken and is no longer in a sealed state, wherein the resealing prevention feature prevents each housing area from being resealed by the cover unit by irreversibly changing the configuration of the case main unit, wherein said irreversible change in the configuration of said case main unit is caused by rotation of a handle component integral to the contact lens carrying case, said rotation of the handle effectuates the detachment of a portion of members comprising a part of said case main unit while said cover unit remains closed, said irreversible change comprising at least one of, a) detachment of the members from the cover unit such that a portion of the members remain in a portion of the case main unit other than the cover unit; or b) detachment of the members from the housing area such that a portion of the members remain in a portion of the case main unit other than the housing area.

8. The contact lens carrying case according to claim 1, wherein said housing unit includes a set of contact lenses stored therein and includes a first housing area that houses a contact lens for the left eye and a second housing area that houses a contact lens for the right eye, as said housing area.

* * * * *